US005494081A

United States Patent [19]

Wiedel

[11] Patent Number: 5,494,081

[45] Date of Patent: Feb. 27, 1996

[54] WIRE TWISTER PINION AND ASSEMBLY

[75] Inventor: John Wiedel, Chicago, Ill.

[73] Assignee: L&P Property Management Company, Chicago, Ill.

[21] Appl. No.: 187,200

[22] Filed: Jan. 26, 1994

[51] Int. Cl.[6] ..... B21F 15/04

[52] U.S. Cl. ..... 140/115; 140/93.6

[58] Field of Search ..... 140/93.6, 115, 140/119

[56] References Cited

U.S. PATENT DOCUMENTS

| | | | |
|---|---|---|---|
| 1,009,006 | 11/1911 | Young | 140/115 |
| 1,334,221 | 3/1920 | Burns | 140/119 |
| 1,460,649 | 7/1923 | Gerrard | 140/93.6 |
| 2,042,843 | 6/1936 | Harvey | 140/93.6 |

OTHER PUBLICATIONS

U.S. Wire–Tie Systems–Operating & Maintenance Instructions and Repair Part List–Model 1302 Portable Pneumatic Wire–Tieing Machine.

*Primary Examiner*—Lowell A. Larson

*Attorney, Agent, or Firm*—Wood, Herron & Evans

[57] ABSTRACT

There is disclosed a wire twister pinion having a slotted body with a central gear portion presenting radially extending teeth defined an imaginary circle of predetermined diameter. The body also includes opposite end journal portions having a diameter at least as great as the predetermined diameter and merging with and supporting opposite ends of the teeth. The wire twister pinion is mounted within and substantially encased by a bearing block and further retained in the bearing block by a pair of yolks attached at opposite ends of the block. The bearing block includes a longitudinal bore for receiving the pinion body and the end journal portions of the pinion body are rotatably supported by the bearing block within the bore.

2 Claims, 2 Drawing Sheets

WIRE TWISTER PINION AND ASSEMBLY

BACKGROUND OF THE INVENTION

The present invention relates to an apparatus for wire-rising and, more particularly, to a novel wire twister pinion gear used in a wire-tieing machine.

Pneumatic, hydraulic, or electric wire-tieing machines having means for gripping and twisting two wires, or opposite ends of the same wire, together, are well-known. One such machine, sold by U.S. Wire-Tie Systems, a unit of the assignee of the present application, is known as the Model-1302 Portable Pneumatic Wire-Tieing Machine. This machine utilizes a slotted wire-twisting pinion having a reduced diameter journal portions extending from opposite ends of a central gear portion. As a result, the teeth of the gear portion are, in effect, cantilevered with respect to the journals. Twister gears are subject to considerable stress and wear during a wire-twisting operation, and it has been found that gears of the type heretofore in use may be subject to breakage and undue wear.

SUMMARY OF THE INVENTION

It is an object of the present invention to provide a novel twister pinion for use in a wire-tieing machine constructed so as to improve its resistance to wear and so as to extend its useful working life as compared with twister pinions heretofore in general use.

A more specific object of the present invention is to provide a novel twister pinion of the above-described type, constructed so as to be more resistant to breakage.

A still further object of the present invention is to provide a novel pinion of the above-described type constructed so as to be easily mountable in a simple and economical bearing structure.

Other objects and advantages of the present invention will become apparent from the following description and the accompanying drawings.

In accordance with the present invention, a slotted pinion body is provided having journal portions at opposite ends thereof of predetermined diameter. Gear teeth are formed in a central body portion between the journal portions. The central body portion has a diameter defined by outer crests of the gear teeth, which is substantially the same as the diameter of the journal portions, so that opposite radially extending ends of the teeth merge with, and are supported by, the journal portions.

DETAILED DESCRIPTION OF THE PREFERRED EMBODIMENT

Figure 1:
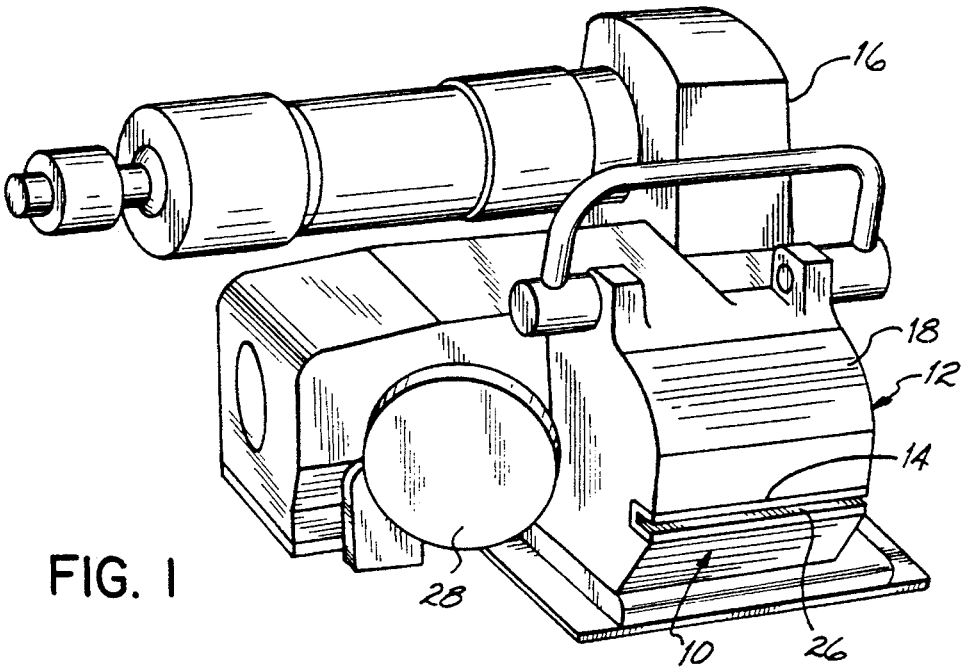
FIG. 1 is a simplified perspective view of a wire-tieing machine in which a wire twister pinion incorporating features of the present invention may be installed.

Referring now to the drawings, wherein like parts are designated by the same numerals throughout the various figures, a wire twister pinion 10 incorporating features of the present invention, is shown in FIGS. 2 through 5. This pinion may be used in various wire-tieing machines of known constructions, so that such machines need not be described in detail herein. FIG. 1 provides a simplified illustration of one such machine 12, in which the pinion 10 is mounted in a bearing block 14. In general, the machine comprises a pneumatic motor 16 adapted to drive the pinion 10 through gearing, not shown, mounted within a housing 18. The machine may also be hydraulically or electrically operated without departing from the scope of the invention.

Figure 6:
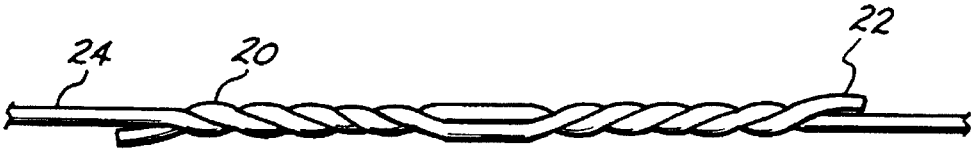
FIG. 6 is a fragmentary view showing ends of a wire twisted and tied by a twister pinion of the present invention.

The machine 12 may be used for twisting or tieing together end portions 20 and 22 of a wire 24 in the manner shown in FIG. 6. In order to accomplish this, the portions 20 and 22 of the wire are inserted into the twister pinion 10 through a slot 26 in the side of the block 14. As will be understood, the wire is frequently used to bundle one or more articles and, therefore, it is desirable to place the wire under tension, so that it is drawn tightly around the articles. This is accomplished by gripping one end of the wire by a suitable gripper means, not shown, and acting on the wire with a tensioning wheel 28, indicated generally in FIG. 1. After the wire is tensioned in a desired manner, the pneumatic motor 16 is actuated so as to drive the twister pinion 10 for tieing the end portions of the wire together, as shown in FIG. 6.

Figure 7:
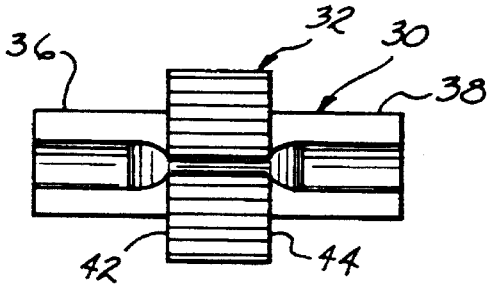
FIG. 7 PRIOR ART
FIG. 7 is a side elevational view of a wire twister pinion constructed in accordance with the prior art.
Figure 8:
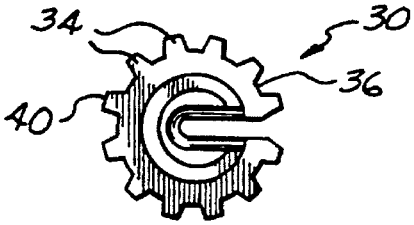
FIG. 8 PRIOR ART
FIG. 8 is an end view of the prior art twister pinion shown in FIG. 7.

Referring now to FIGS. 7 and 8, a wire twister pinion 30 constructed in accordance with the prior art is shown. This prior art pinion comprises a body having a central slotted gear portion 32 with gear teeth 34 of conventional profile. The pinion body also includes journal portions 36 and 38 at opposite ends thereof. It is to be noted that the journal portions 36 and 38 have a diameter which is greatly reduced as compared with the diameter of an imaginary circle defined by outer crests 40 of the gear teeth 34. Thus, as shown in FIG. 8, the gear teeth 34 are cantilevered with respect to the journal portions of the pinion body. Furthermore, opposite end faces 42 and 44 of the gear teeth are free and unsupported relative to the journal portions 36 and 38, as shown best in FIG. 7. As will be understood, the wire twister pinion is subjected to considerable forces and pressures when it is driven, so as to twist the wire 24 into the condition shown in FIG. 6. Such pressures are increased significantly as the hardness of the wire, which is to be tied, increases. It has been found, that the relatively small diameter bearing surfaces of the journals 36 and 38, and the mating bearing, not shown, in the machine in which they are mounted may be subject to excessive wear. Furthermore, the cantilevered and unsupported teeth 34 may be subject to undue breakage. Such wear and breakage is reduced or eliminated by constructing a wire twisting pinion in accordance with the present invention, as described below.

Referring now again to FIGS. 2–5, it is seen that the wire twister pinion 10 of the present invention comprises a pinion body 46 having a central gear portion 48 and opposite end journal portions 50 and 52. A slot 54 is formed in the pinion body for receiving the wire to be twisted. Opposite end portions 56 and 58 of the slot 54, which extend through the journal portions 50 and 52, have a width which is at least as great as twice the diameter of the wire 24 to be twisted, so as to provide clearance for the twisted portions of the tied wire. A central portion 60 of the slot 54 is defined by converging wall sections 62 and 64, so as to have a width similar to and slightly larger than the diameter of the wire 24 to be twisted. Thus, when the wire ends are inserted into the slot 54, the wall portions 62 and 64 grip segments of the wires so as to prevent them from twisting around each other, as indicated by the central portion of the tied wire shown in FIG. 6.

Figure 3:
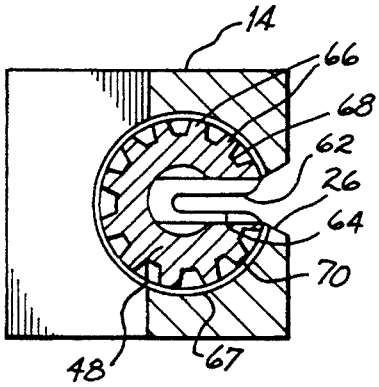
FIG. 3 is a sectional view taken along line 3—3 in FIG. 2.

The central gear portion 48 of the pinion body is formed with gear teeth 66. These gear teeth have mid-portions with a conventional gear tooth profile, as indicated in FIG. 3. However, it is important to note that, in accordance with the present invention, an imaginary circle defined by crests 70 of the teeth 66 has a diameter which is slightly less than, and preferably similar to, the outer diameter of the journal end portions 50 and 52 of the pinion body. With this arrangement, the bearing surfaces of the journal portions are relatively large in diameter, as compared with the prior art pinion described above. Furthermore, a simple and economical mounting for the pinion 10 can be provided by boring a straight hole 67 in the bearing block 14, since the teeth 66 will not interfere with the surface of the hole 67.

Figure 2:
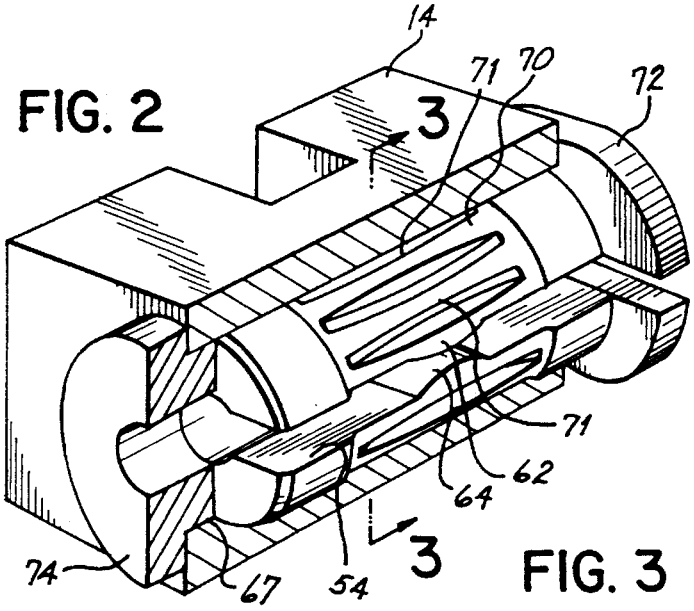
FIG. 2 is an enlarged perspective view, partially broken away, showing a wire twister pinion constructed in accordance with the present invention, mounted in a bearing block.
Figure 4:
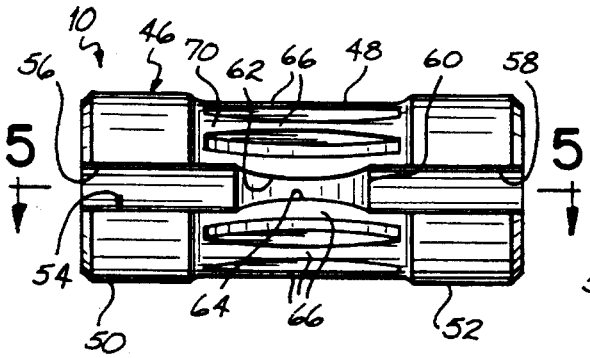
FIG. 4 is a side elevational view of a wire twister pinion incorporating features of the present invention.
Figure 5:
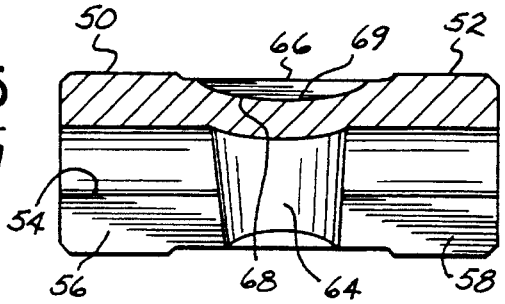
FIG. 5 is a sectional view taken along line 5—5 in FIG. 4.

It is also important to note that, as shown in FIGS. 2, 4, and particularly FIG. 5, opposite ends of the teeth 66 are of progressively decreasing height and have root surfaces 68 of concave configuration, so that they gradually extend from a flat bottom portion 69 substantially to the full diameter of the journal portions 50 and 52. Furthermore, as shown best in FIGS. 2 and 4, the circumferential width of the crests 70 of the teeth gradually increases from straight central portions 71 of the teeth toward the opposite journal portions of the pinion body. With this structure, it is apparent that the opposite ends of the central portions of the teeth, which will be directly engaged by a driving gear, not shown, are well supported by the journal portions of the pinion body, so that the likelihood of breakage during use is greatly diminished.

As indicated above, because of the relationship between the outer diameters of the journal portions 50 and 52 and the Gear portion 48, the pinion may be easily mounted simply by inserting it into a drilled aperture 67 in the bearing block 14. As indicated in FIG. 2, the pinion may be fixed against axial displacement within the bearing block by any suitable means, such as yolks 72 and 74, which are adapted to retain opposite ends of the wire during the twisting operation.

While a preferred embodiment of the present invention has been shown and described herein, structural changes may be made without departing from the spirit and scope of the appended claims.

The invention is claimed as follows:

1. A wire twister pinion assembly for use in a wire-tieing machine comprising a bearing block, a slotted pinion body mounted within and substantially encased by said bearing block, and a pair of yolk members attached at opposite ends of said bearing block to retain said pinion body within said block, said pinion body including opposite end journal portions and an intermediate gear portion, radially extending gear teeth on said gear portion having crests defining an imaginary circle of predetermined diameter, opposite ends of said teeth merging with and being supported by the journal portions, said predetermined diameter being less than an outer diameter of said end journal portions, said bearing block having an elongated slot for receiving wire to be twisted and a longitudinal bore for slidably receiving said pinion body through one end of said bearing block, said elongated slot intersecting said longitudinal bore, said end journal portions being rotatably supported by said bearing block within said bore, and said yolk members including slots aligned with said pinion body slot and said elongated slot to retain opposite ends of said wire during twisting operation of said wire-tieing machine.

2. The wire twister pinion assembly, as defined in claim 1, wherein said bearing block is a unitary piece.

* * * * *